US008770434B2

(12) United States Patent
Shearer

(10) Patent No.: US 8,770,434 B2
(45) Date of Patent: Jul. 8, 2014

(54) FLOATING INSULATING BEVERAGE CONTAINER

(71) Applicant: Neal A. Shearer, Houma, LA (US)

(72) Inventor: Neal A. Shearer, Houma, LA (US)

( * ) Notice: Subject to any disclaimer, the term of this patent is extended or adjusted under 35 U.S.C. 154(b) by 0 days.

(21) Appl. No.: 13/670,755

(22) Filed: Nov. 7, 2012

(65) Prior Publication Data

US 2014/0124513 A1 May 8, 2014

(51) Int. Cl.
*A47G 19/22* (2006.01)
*B65D 1/26* (2006.01)

(52) U.S. Cl.
CPC ..... *A47G 19/2261* (2013.01); *A47G 19/2288* (2013.01); *B65D 1/265* (2013.01)
USPC ..... 220/603

(58) Field of Classification Search
CPC ..... A47G 19/2272; A47G 2200/22; A47G 2019/2294; A47G 19/2261; B65D 7/22
USPC ..... 220/603, 62.18, 62.12, 592.17, 592.16, 220/62.11; 441/1, 136, 32; 215/373, 372, 215/371, 370
See application file for complete search history.

(56) References Cited

U.S. PATENT DOCUMENTS

| | | | | | |
|---|---|---|---|---|---|
| 1,517,978 | A * | 12/1924 | Giese | 220/62.18 |
| 2,526,165 | A * | 10/1950 | Smith | 62/457.3 |
| 4,388,996 | A * | 6/1983 | Panicci | 220/603 |
| 5,088,948 | A * | 2/1992 | Scheurer | 441/1 |
| 5,398,842 | A * | 3/1995 | Sokolski et al. | 220/630 |
| 5,727,709 | A * | 3/1998 | Nobile | 220/560 |
| 6,530,496 | B2 * | 3/2003 | Moran | 220/603 |
| 6,607,090 | B1 * | 8/2003 | Doerr | 220/560 |
| 6,991,505 | B1 * | 1/2006 | Wells | 441/136 |
| 2006/0006182 | A1 * | 1/2006 | Raft | 220/603 |

* cited by examiner

*Primary Examiner* — Robert J Hicks

(57) ABSTRACT

A self righting floating insulating beverage container consists of a double walled beverage container which is adequately buoyant and balanced to remain upright in a body of water. The adequate buoyancy and balanced is achieved by the buoyant forces available from an annular cavity created by the double wall container configuration and the balance by the non-buoyant or ballasted bottom of the container. The double wall annular space and ballasted weight are determined to maintain the drink container upright in a body of water, without sinking when filled with beverage, and not capsizing when empty. The double wall configuration also provides insulation for the beverage due to the void between the inner and outer walls.

2 Claims, 3 Drawing Sheets

FLOATING INSULATING BEVERAGE CONTAINER

FIELD OF THE INVENTION

The present invention generally relates to beverage containers, and in particular those beverage containers which are configured and designed to be utilized during and in conjunction with various aquatic activities.

BACKGROUND OF THE INVENTION

Aquatic activities, for recreation or relaxation, may be enjoyed in a body of water such as a swimming pool, jacuzzi, lake, beach, or the like. As many of these activities are enjoyed during the summer, beverages are commonly enjoyed by the participants during those times.

Beverages are commonly available in open containers nearby to these activities. However most much suspend their aquatic activities or leave the water temporarily to enjoy a cooling beverage. Generally beverage containers are not buoyant and its contents likely spill into the water.

A beverage container would be most convenient which would float upright and not tip over and spill its contents during the course of such activities.

DESCRIPTION OF THE PRIOR ART

Conventional beverage containers made of metal or glass are generally not well suited for use in connection with water sports activities as they are not buoyant, nor self righting and may cause personal injury if not handled properly. Plastic beverage containers generally are not configured to provide upright flotation when placed in water A search for floating, buoyant beverage containers which are configured to float upright in a body of water are presently unavailable.

OBJECTS OF THE INVENTION

The principal object of the present invention is to provide a floating beverage container which is configured to float upright in a body of water such as a swimming pool, jacuzzi, lake, beach, or the like.

The general object of the present invention is to improve the upright stability of a beverage container for use in water.

SUMMARY OF THE INVENTION

The beverage container herein is configured and designed to float upright in water such a swimming pool, jacuzzi, lake, beach, or the like includes a double-walled plastic beverage container which is sufficiently buoyant and balanced to perform as intended. The hollow annular space created between the inner and outer container side walls provide the buoyant forces necessary for floatation while sufficient ballasted weight is positioned at the bottom of the container to float upright when in use.

The volumetric dimensions of the annulus and the ballasted weights are calculated to provide the necessary flotation balance. Prototypes have been successfully tested with positive results. The ballasted weight is determined to maintain the buoyant beverage container upright in a body of water, without sinking when filled with beverage, and without spilling when near empty or capsizing when empty.

BRIEF DESCRIPTION OF THE DRAWINGS

Advantages of the presented invention will be better understood upon reading the detailed description which follows with reference to the attached drawings, wherein.

DETAILED DESCRIPTION OF THE PREFERRED EMBODIMENTS

Figure 1:
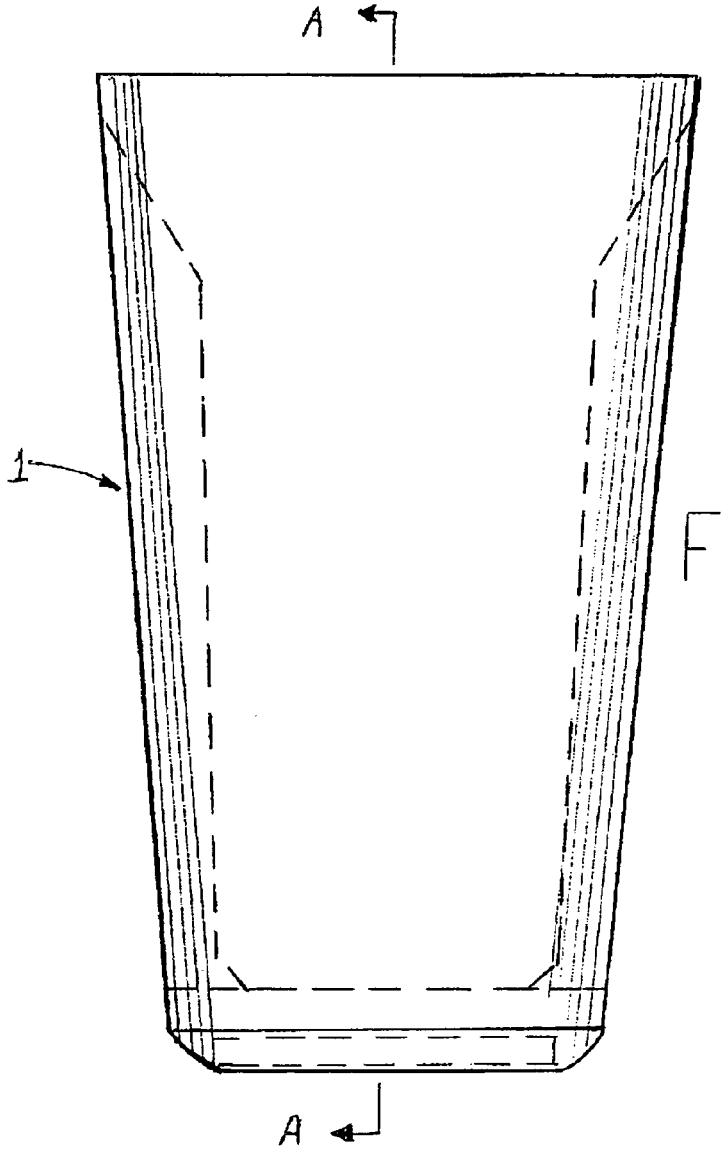
FIG. 1 is a front elevation view of an upright floating beverage container constructed according to the description of the invention presented herein.

In the description which follows, like parts are indicated throughout the specification and drawings with the same reference numerals, respectively. The drawings are not necessarily to scale and the proportions of certain parts have been exaggerated to better illustrate details of the invention.

Figure 2:
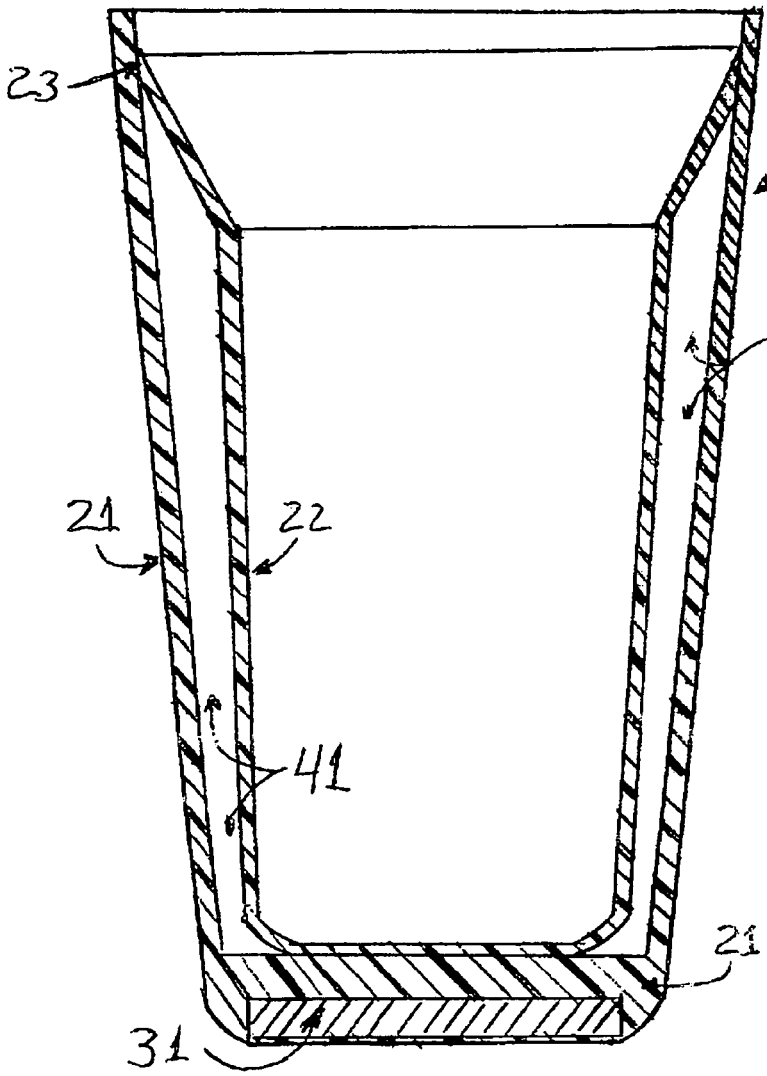
FIG. 2 is a sectional view taken along the lines A-A of FIG. 1.
Figure 3:
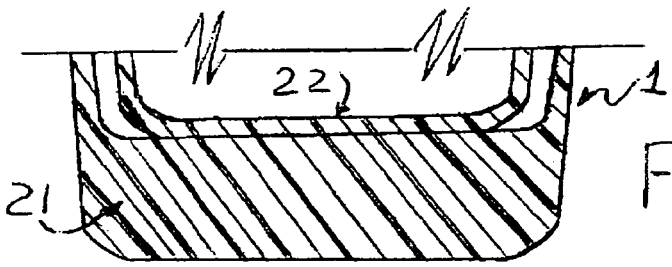
FIG. 3 is a sectional view, partly broken away, of an alternate embodiment of the balance ballast an upright floating beverage container.
Figure 4:
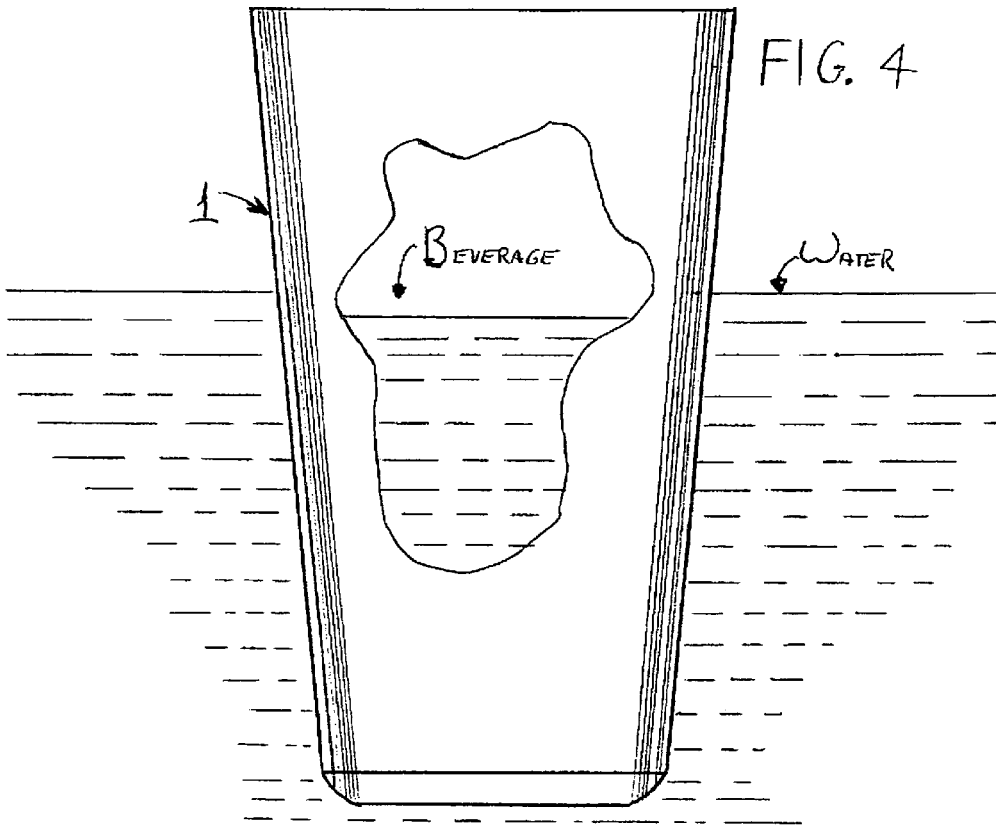
FIG. 4 is an elevation view, partly broken away, of the floating upright beverage container of FIG. 1 shown floating upright in a body of water.

Referring to FIG. 1, FIG. 2 and FIG. 3, the beverage container 1 is intended and configured for use in a body of water to provide convenient access to a beverage for persons in the water. As shown in FIG. 4, the beverage container 1 is adapted to float upright in the water W, and not tip or capsize and spill its beverage contents B during use.

The principal components of the beverage container are an outer wall 21, an inner wall 22, and the dense ballast material 31. The container walls 21 and 22 are constructed of an approved drinking material, and the ballast of dense material or metal.

The outer and inner container walls are affixed together at their tops that mate at location 23. Securing these two components together can be performed by common manufacturing practices such as solvent, heat, or other practices.

The balance ballast 31 shall be encapsulated or otherwise affixed to the lowest point practical in the base of the outer container 21.

As most plastics suitable for this application have a specific gravity near that of water, the buoyant forces generated by the void air gap between the outer container wall 21 and the inner container wall 22 will need to be in excess of the balance ballast weight 31 necessary to keep the vessel floating upright as intended.

There exists a volume in the annular cavity 41 which encircles inner container wall 22 inside the outer container wall 21. The vertical profile of annular cavity 41 may vary to obtain the necessary buoyancy based on Archimedes Principle whereas the buoyant force is equal to the weight of the volume displaced.

The profile and volume created by the annular cavity generates the buoyancy needed to exceed the balance ballast and container weight can be readily calculated using common geometric equations and inputting the ID of the outer container wall OD of the inner container wall, and the vertical distance of the cavity. Cylindrical or conical equations shall be used that would apply to the shape of the vessel based on the profile of the void. The profile of the inner and outer container walls may vary significantly to obtain the desired asthetics and functionality of the object.

FIG. 3 illustrates an alternate embodiment of the above concept where additional container material is utilized to generate the desired balance ballast weight.

The afore described floating beverage containers can be produced utilizing commercially available materials commonly used for drink containers. Calculations of the volumes required for buoyancy and balance ballast weights required result in dimensions practical for beverage containers. As stated earlier, containers intended for this purpose were not found to be available.

Although this invention has been described in part by making detailed references to certain specific embodiments, such detail is intended to be, and will be understood to be, instructional rather than restrictive. Variations may be made in the structure and method of manufacture and assembly without departing from the spirit and scope of the invention as described herein.

What is claimed is:

1. A beverage container designed to float upright when placed in water consisting of a double walled drink container with void circumferential annular space of sufficient profile and volume to provide adequate buoyant forces to float upright when in use and ballasted at its bottom to provide adequate balance to maintain the container upright when empty.

2. The floating beverage container of claim 1 wherein the ballasted container bottom shall consist of sufficient container material to provide adequate balance to maintain the container upright when empty.

* * * * *